US006966193B2

(12) United States Patent
Dobmeier et al.

(10) Patent No.: US 6,966,193 B2
(45) Date of Patent: Nov. 22, 2005

(54) CONTROL OF MULTI-CIRCUIT ECONOMIZED SYSTEM

(75) Inventors: Thomas J. Dobmeier, Phoenix, NY (US); Michael F. Taras, Fayetteville, NY (US); Alexander Lifson, Manlius, NY (US)

(73) Assignee: Carrier Corporation, Farmington, CT (US)

( * ) Notice: Subject to any disclaimer, the term of this patent is extended or adjusted under 35 U.S.C. 154(b) by 38 days.

(21) Appl. No.: 10/776,096

(22) Filed: Feb. 11, 2004

(65) Prior Publication Data

US 2005/0172663 A1 Aug. 11, 2005

(51) Int. Cl.[7] ..... F28B 41/00; F25B 41/00
(52) U.S. Cl. ..... 62/196.2; 62/513; 62/510
(58) Field of Search ..... 62/510, 513, 228.1, 62/196.1, 196.2, 197

(56) References Cited

U.S. PATENT DOCUMENTS 4,876,859 A 10/1989 Kitamoto
5,875,637 A 3/1999 Paetow
6,047,556 A 4/2000 Lifson
6,206,652 B1 3/2001 Caillat
6,474,087 B1 * 11/2002 Lifson ..... 62/199
2005/0086975 A1 * 4/2005 Dobmeier et al. ..... 62/513

OTHER PUBLICATIONS

Systems & Advanced Technologies Engineering S.r.I., publication entitled "Compsys—Dynamic Simulation of Gas Compression Plants", dated Jun. 12, 2002.
Copeland Europe publication entitled "Refrigeration Scroll for Parallel Applications" dated Feb. 26, 2002.

* cited by examiner

*Primary Examiner*—Chen Wen Jiang
(74) *Attorney, Agent, or Firm*—Carlson, Gaskey & Olds

(57) ABSTRACT

Multiple refrigerant circuits are operated in parallel, and each has an economizer cycle. One of the two circuits may have a greater capacity than the other. By controlling the two circuits to run in economized, conventional, bypassed, or economizer bypassed operation, the control is able to match demanded capacity. Moreover, by exercising similar technique, the control can provide better humidity control, can limit or maintain head pressure, and can avoid power consumption peaks.

12 Claims, 2 Drawing Sheets

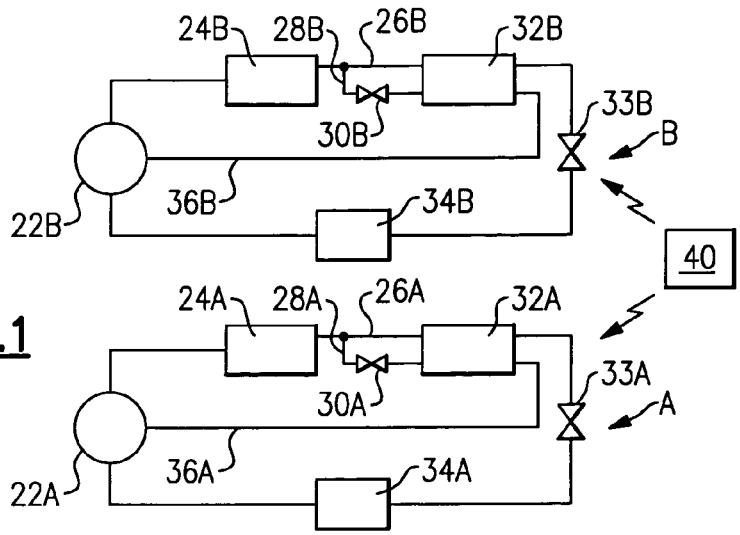
FIG.1
| STAGE NUMBER | COMPRESSOR 1 | | COMPRESSOR 2 | |
|---|---|---|---|---|
| | ECONOMIZED | NON-ECONOMIZED | ECONOMIZED | NON-ECONOMIZED |
| 1 | OFF | ON | OFF | OFF |
| 2 | OFF | OFF | OFF | ON |
| 3 | ON | OFF | OFF | OFF |
| 4 | OFF | OFF | ON | OFF |
| 5 | OFF | ON | OFF | ON |
| 6 | ON | OFF | OFF | ON |
| 7 | OFF | ON | ON | OFF |
| 8 | ON | OFF | ON | OFF |
FIG.2
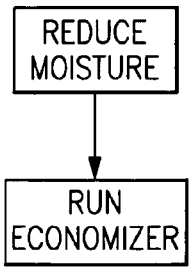
FIG.4
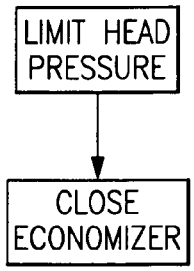
FIG.5
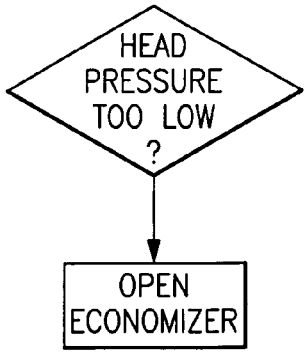
FIG.6
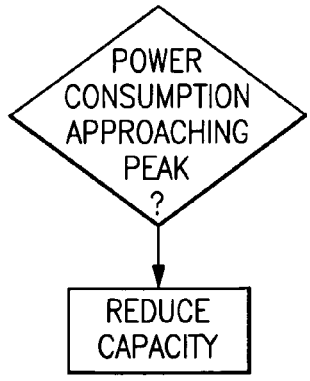
FIG.7

CONTROL OF MULTI-CIRCUIT ECONOMIZED SYSTEM

BACKGROUND OF THE INVENTION

This application relates to several operating parameters in a refrigerant cycle that are controlled by management of an economized cycle in a multi-circuit refrigerant system.

Refrigerant systems are utilized to condition (e.g., heat/cool) an environment. As is known, in a cooling mode a refrigerant cycle typically includes a compressor that compresses a refrigerant and delivers the refrigerant to a condenser. From the condenser, the refrigerant passes into an expansion device, and then downstream to an evaporator. From the evaporator, the refrigerant is returned to the compressor. In a heat mode, the flow is generally reversed.

One type of refrigerant cycle that improves efficiency, increases the capacity and provides additional control options to a designer, is an economizer cycle. In an economized refrigerant cycle, the refrigerant downstream of the condenser is split into two flows. The smaller of the two flows is expanded to reduce temperature of this tapped refrigerant, and then passed through an economizer heat exchanger. A main portion of the split flow also passes through the economizer heat exchanger. The expanded economizer flow cools the main refrigerant flow. When this main flow refrigerant reaches the evaporator, it thus has greater cooling capacity. The tapped refrigerant is typically returned to a compressor at an intermediate compression point downstream of the economizer heat exchanger.

While economized cycles do provide increasing capacity, they also provide options for additional control features. Many of these features have yet to be exploited.

SUMMARY OF THE INVENTION

In a disclosed embodiment of this invention, a control for a refrigerant cycle closes or opens an economizer cycle for one or more refrigerant circuits to achieve various system control parameters. In one feature of the present invention, there may be two circuits operating in parallel. The control can operate these two equivalent circuits to provide as many as eight different levels of capacity. As an example, both refrigerant circuits could be operated in the economized mode, or could be run in the conventional non-economized mode, or could be run unloaded, or could be operated in the unloaded economized mode. If the two compressors have different capacity levels, then just conventional and economized options provide eight different levels of capacity.

These levels of unloading can also be utilized to provide greater humidity control. Various levels of unloading can be equated to the system's ability to remove moisture from the air. Thus, the control can determine whether greater humidity control is desirable, and can reduce the amount of humidity in the environment by maintaining an unloading level corresponding to desired humidity values.

In another feature, if the head pressure is higher than would be desired, the control may turn off the economizer branch of the cycle, for example. This would reduce an amount of refrigerant circulating through the condenser and consequently reduce the head pressure. This feature would provide benefits by preventing nuisance shutdowns associated with high discharge pressure, though the system will be operating in the unloaded mode.

On the other hand, the control may also ensure that a minimum head pressure is achieved by opening an economizer cycle, should the head pressure be lower than desired, or approaching a lower limit. This eliminates system shutdown and reliability problems associated with low suction pressure and compressor flooding.

In another feature, should there be conditions indicating that a power consumption control may be approaching a limit, such as high load conditions, the control may move the refrigerant circuits through the several levels of unloading such as described above to provide capacity reduction. This feature also provides benefits in both single and multiple circuit systems.

These and other features of the present invention can be best understood from the following specification and drawings, the following of which is a brief description.

BRIEF DESCRIPTION OF THE DRAWINGS

FIG. 1 shows a schematic of a refrigerant cycle.

FIG. 2 is a table of various capacity steps provided by this invention.

FIG. 4 is a flowchart of another feature.

FIG. 5 is a flowchart of another feature.

FIG. 6 is a flowchart of another feature.

FIG. 7 is a flowchart of yet another feature.

DETAILED DESCRIPTION OF THE PREFERRED EMBODIMENT

Figure 3:
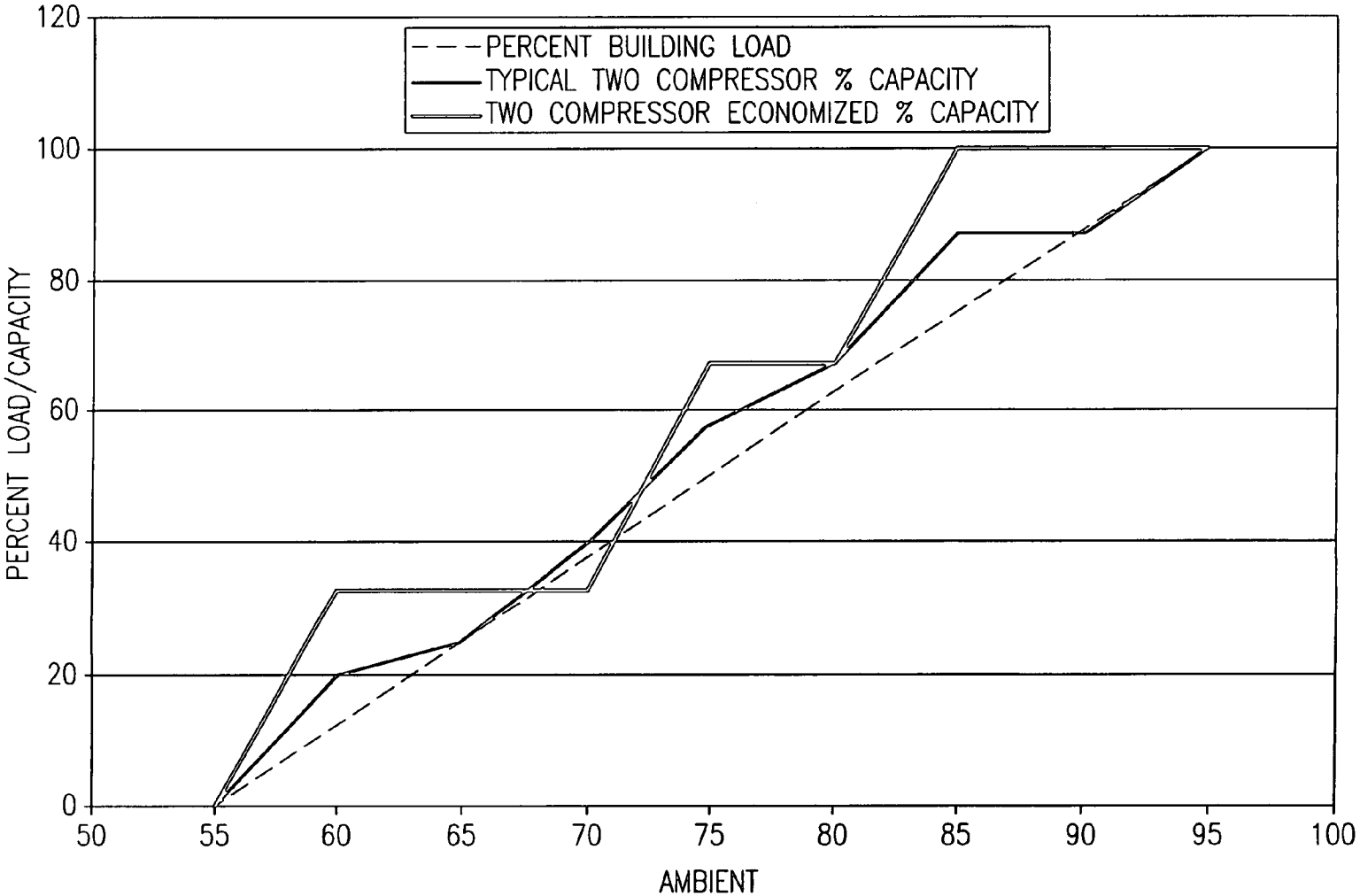
FIG. 3 is a chart showing how the stages of FIG. 2 can match a demand.

FIG. 1 shows a refrigerant cycle 20 incorporating two circuits A and B. Each circuit includes a compressor 22, a condenser 24, a main liquid line 26 downstream of the condenser, and a tap economizer line 28 tapped from this main liquid line 26. As shown, a return line 36 returns refrigerant from the tap economizer line 28 back to an intermediate point in the compressor 22. Compressor 22 is preferably a scroll compressor, and as known, the returning refrigerant from the line 36 is returned at an intermediate point in the compression cycle.

An economizer expansion device 30 is positioned on the tap line 28. The economizer refrigerant flow in the tap line 28, and the main flow in liquid line 26 both pass through an economizer heat exchanger 32. Downstream of the economizer heat exchanger 32, the main flow passes through an expansion device 33, through an evaporator 34, and then returns to the suction port of the compressor 22.

FIG. 2 shows the several levels of capacity available if the two compressors 22A and 22B are of different sizes. Thus, as shown, by just having the economized operation on or off for each of the two compressors (in addition to the conventional modes of operation), eight levels of capacity can be provided. In the chart illustrated as FIG. 2, the compressor associated with circuit 2 is larger, such that these eight numerically different stages of unloading are provided. A control 40 is thus operable to either turn off the compressors 22A and 22B, or run the cycle with the economizer expansion device 30 shut down to stop economized operation. It should be understood that the economizer expansion device 30 may also be a shut-off device, or a separate shut-off device could be utilized in combination with the expansion device. The separate shut-off device can be upstream or downstream of the economizer heat exchanger 32. Further, it should be appreciated that while the flow from the tap 28 and the main flow 26 are both shown to pass in the same direction through the economizer heat exchanger 32, in preferred embodiments, they preferably flow in a counterflow relationship. Also, it has to be understood that additional stages of unloading can be provided by the conventional unloaded and unloaded economized operation modes.

The control can compare the required load and system capacity, and match the demand more accurately than the prior art. As shown for example in FIG. 3, without the economized operation, the actual capacity provided does not come nearly as close to the demand, and also cannot meet the higher levels of demand that can be met by the disclosed two economizer circuit system.

The nominal capacity of circuit A is less than circuit B. As can be appreciated from FIG. 2, the capacity of the two compressors is preferably selected such that the capacity level of the stage A, in economized operation, is greater than the capacity of stage B in non-economized operation. In this manner, the eight stages of capacity can be provided.

As shown in FIG. 4, if the control 40 determines that the humidity in the environment to be conditioned should be reduced, then greater capacity levels may be provided than what might otherwise be demanded by the system, as shown in FIG. 2. That is, while maintaining a higher capacity than might be necessary for temperature control, one is able to provide better humidity control. This idea could be used separately, or in combination with other methods of humidity control. Essentially, by tending to utilize economized operation, one provides greater ability to remove moisture. Also, moisture levels can be controlled even more accurately if the bypassed or economized bypass operations are employed.

As an example, should the system be operating at level 6, and more humidity control is desired, the control can move the system to level 7, such as by moving circuit B to economized operation. Of course, given that the levels are selected to be relatively close to each other, only a small incremental step is provided by any one level change.

As shown in FIG. 5, at some conditions, and particularly in operation at high ambient temperatures, the head pressure on the system may approach undesirably high levels. This may sometimes require that a circuit could reach a threshold limit, and the compressor may need to be shut down. The control 40 may be operable to cycle the compressors on and off to avoid these trip points. However, since the control can also choose to move into, or out of, economized operation, it has another method of addressing high head pressures. The control will tend to move the operation toward the shutting down of economized operation to avoid these limits. As an example, should the system be operating at level 7, and the circuit B be approaching a head pressure limit, the control 40 may decide to move to level 6, such that the circuit B is no longer operating in the economized mode. By closing off the economized operation, the head pressure will generally be lower. Again, since the levels may be quite close, the difference between levels 6 and 7 does not provide an undue amount of excess capacity, while still providing relief from the high head pressure.

On the other hand, it is also sometimes true at low ambient temperatures that there is insufficient head pressure. Under such conditions, evaporator coil freezing or compressor flooding may result, which would be undesirable. Again, utilizing the economized scheme, the economizers can be cycled on to maintain system head pressure at a level where flooding of the compressor can be avoided. The exact opposite would be done as in the prior example. For example, if the control understood that it was operating at level 6, and circuit B had an undesirably low head pressure, it could move to level 7, opening the economizer on circuit B, and thus increasing the head pressure.

As shown in FIG. 7, the control may also move to lower operation capacity levels should a power consumption level approach a peak. As an example, if circuit B power consumption were approaching a peak, with the circuit at level 7, the control could move the two circuits to level 6. In this manner, circuit B, which might have been approaching a power peak, has its operating power reduced, and the control need not cycle the system off, which may be the case due to compressor motor power limitation or entire power grid requirements.

In general, a control is thus provided with several options to manage various refrigerant cycle modes of operation. It should be understood that many of these parameters will provide benefits in a single circuit system, although each of them also provide benefits as shown in the dual circuit system of the present invention, or in other refrigerant cycles where more than two circuits are utilized.

In addition to having an economized circuit, the circuits can be equipped with additional unloading capabilities where an economizer line is connected to a suction line with an additional shut-off valve placed into this line, as known. In this case, additional refrigerant cycle control can be achieved by selectively opening and closing this valve.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A refrigerant cycle comprising at least two circuits, with each of said circuits having a compressor, a first heat exchanger and a second heat exchanger with an intermediate expansion device, and an economized cycle intermediate one of said first and second heat exchangers and said main expansion device, a line leading from said one of said first and second heat exchangers to an economizer heat exchanger having a tap that taps off a portion of a refrigerant flow in said line, with the main portion of refrigerant flow in said line passing through said economizer heat exchanger, and said portion in said tap passing through an economizer expansion device, and passing from said economizer expansion device into said economizer heat exchanger;

said main portion of refrigerant flowing from said first heat exchanger, through said economizer heat exchanger, to said main expansion device, and then to the other of said first and second heat exchangers, and from there back to said compressor; and a control for controlling operation of said at least two circuits, said control being operable to turn off or turn on each of said economizer cycles, and to stop or run each of said compressors to achieve a desired system condition.

2. A cycle as set forth in claim 1, wherein said control controls the operation to match provided capacity and demanded capacity.

3. A cycle as set forth in claim 1, wherein said desired system condition is humidity control.

4. A cycle as set forth in claim 1, wherein said desired system condition is control of head pressure.

5. A cycle as set forth in claim 4, wherein said control determines that head pressure should be limited, and moves said system to have a closed economizer cycle on a circuit experiencing an undesirably high head pressure.

6. A cycle as set forth in claim 5, wherein said control determines that head pressure is too low on one of said circuits, and opens said economizer cycle associated with said circuit.

7. A cycle as set forth in claim 1, wherein said compressors associated with each of said two circuits have different capacities, such that eight distinct levels of capacity can be provided by opening or closing said economizer cycles, and running or not running said compressors.

8. A method of operating a refrigerant cycle comprising the steps of:

(1) providing a refrigerant cycle with at least two circuits each having a compressor, a first and second heat exchanger downstream of said compressor, and a main expansion device intermediate said first and second heat exchangers, an economizer intermediate said expansion device and one of said first and second heat exchangers, said economizer heat exchanger having a tap that taps off a portion of a refrigerant flow in said line, with the main portion of refrigerant flow in said line passing through said economizer heat exchanger, and said portion in said tap passing through an economizer expansion device, and passing from said economizer expansion device into said economizer heat exchanger, said two compressors having different capacities; and (2) controlling said circuit by opening or closing said economizer cycle, and running or stopping said compressors associated with each of said at least two circuits to provide desired levels of capacity.

9. A method as set forth in claim 8, wherein said control of step (2) is utilized to match a demanded system capacity.

10. A method as set forth in claim 8, wherein said control of step (2) is utilized to provide humidity control.

11. A method as set forth in claim 8, wherein said control of step (2) is utilized to control head pressure.

12. A method as set forth in claim 8, wherein said control of step (2) is utilized to lower power consumption if a control indicates that a power consumption level is approaching an undesirably high level.

* * * * *